US010378079B2

(12) United States Patent
Tomio et al.

(10) Patent No.: US 10,378,079 B2
(45) Date of Patent: Aug. 13, 2019

(54) STAINLESS STEEL AND STAINLESS STEEL PRODUCT FOR OIL WELL

(71) Applicant: NIPPON STEEL & SUMITOMO METAL CORPORATION, Tokyo (JP)

(72) Inventors: Yusaku Tomio, Nishinomiya (JP); Hiroshi Kaido, Sodegaura (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 15/747,825

(22) PCT Filed: Jun. 29, 2016

(86) PCT No.: PCT/JP2016/069241
§ 371 (c)(1),
(2) Date: Jan. 26, 2018

(87) PCT Pub. No.: WO2017/022374
PCT Pub. Date: Feb. 9, 2017

(65) Prior Publication Data

US 2018/0209009 A1 Jul. 26, 2018

(30) Foreign Application Priority Data

Aug. 4, 2015 (JP) ..... 2015-154360

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 1/25* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0247* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01);
(Continued)

(58) Field of Classification Search
CPC ... C21D 2211/008; C22C 38/02; C22C 38/04; C22C 38/06
See application file for complete search history.

(56) References Cited

U.S. PATENT DOCUMENTS 3,650,709 A * 3/1972 Morsing ..... B23K 35/3086 376/288
7,862,666 B2 * 1/2011 Kimura ..... C21D 1/25 148/325
2012/0328897 A1 12/2012 Ohe et al.

FOREIGN PATENT DOCUMENTS

EP 1 683 885 7/2006
EP 2 256 225 12/2010
(Continued)

OTHER PUBLICATIONS

The Japan Society for Technology of Plasticity, Corporate Judicial Person, "Plate Rolling—Rolling techniques that lead the world", Feb. 1993, and its English translation.

*Primary Examiner* — Jessee R Roe
*Assistant Examiner* — Jophy S. Koshy
(74) *Attorney, Agent, or Firm* — Clark & Brody

(57) ABSTRACT

A stainless steel is provided having good corrosion resistance and good low-temperature toughness. A stainless steel contains, in mass %, Cr: 15.5 to 18.0%. The stainless steel has a matrix structure having, by volume ratio, 40 to 80% tempered martensite, 10 to 50% ferrite and 1 to 15% austenite. When a microstructure image obtained by photographing the matrix structure at a magnification of 100 times is positioned in an x-y coordinate system and each of 1024×1024 pixels is represented by a gray scale level, β defined by Equation (2) is not smaller than 1.55:

$$1.0 \leq Mo + 0.5W \leq 3.5 \quad (1).$$

Here, Mo and W are the Mo and W contents in mass %.

[Formula 1]

$$\beta = \frac{Su}{Sv} \quad (2)$$

In Equation (2), Su is defined by Equation (3), and Sv is defined by Equation (4):

[Formula 2]

$$Su = \sum_{u=1}^{1023} \|F(u, 0)\| \quad (3)$$

$$Sv = \sum_{v=1}^{1023} \|F(0, v)\| \quad (4)$$

In Equations (3) and (4), F(u,v) is defined by Equation (5):

[Formula 3]

$$F(u, v) = \sum_{x=0}^{1023} \sum_{y=0}^{1023} f(x, y) \exp\left\{-2\pi i\left(\frac{ux}{1024} + \frac{vy}{1024}\right)\right\} \quad (5)$$

In Equation (5), f(x,y) represents the gray level of the pixel at coordinates (x,y).

16 Claims, 5 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C21D 1/25*** | (2006.01) |
| *C21D 8/00* | (2006.01) |

(52) U.S. Cl.

CPC ..... *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 8/00* (2013.01); *C21D 2211/001* (2013.01); *C21D 2211/005* (2013.01); *C21D 2211/008* (2013.01)

(56) References Cited

FOREIGN PATENT DOCUMENTS

| | | |
|---|---|---|
| EP | 2 562 284 | 2/2013 |
| EP | 3 246 418 | 11/2017 |
| JP | 2005-336595 | 12/2005 |
| JP | 2010-209402 | 9/2010 |
| WO | 2010/050519 | 3/2012 |
| WO | 2010/134498 | 11/2012 |
| WO | 2013/179667 | 12/2013 |
| WO | 2015/033518 | 3/2015 |
| WO | 2013/146046 | 12/2015 |

* cited by examiner

STAINLESS STEEL AND STAINLESS STEEL PRODUCT FOR OIL WELL

TECHNICAL FIELD

The present invention relates to a stainless steel, and more particularly to a stainless steel product for an oil well.

BACKGROUND ART

Conventionally, martensitic stainless steel has been widely used in oil-well environments. A conventional oil-well environment contains carbon dioxide gas ($CO_2$) and/or chloride ions ($Cl^-$). A martensitic stainless steel containing about 13 mass % Cr (hereinafter referred to as 13% Cr steel) has good corrosion resistance in such a conventional oil-well environment.

In recent years, higher oil prices have prompted development of deep-sea oil wells. Deep-sea oil wells are located at large depths. In addition, deep-sea oil wells have high corrosivity and high temperatures. More specifically, a deep-sea oil well contains high-temperature corrosive gases. Such corrosive gases contain $CO_2$ and/or $Cl^-$, and may contain hydrogen sulfide gas. A corrosion reaction at a high temperature is severer than a corrosion reaction at room temperature. In view of this, an oil-well steel for use in a deep-sea oil well is required to have a strength and corrosion resistance higher than those of a 13% Cr steel.

A duplex stainless steel has a higher Cr content than a 13% Cr steel. Thus, a duplex stainless steel has a higher corrosion resistance than a 13% Cr steel. A duplex stainless steel may be, for example, a 22% Cr steel containing 22% Cr, or a 25% Cr steel containing 25% Cr. However, a duplex stainless steel is expensive as it contains a larger amount of alloy elements. Thus, there is a demand for a stainless steel that has a higher corrosion resistance than a 13% Cr steel and is less expensive than a duplex stainless steel.

To address this demand, a stainless steel containing 15.5 to 18% Cr and having high corrosion resistance in high-temperature oil-well environments has been proposed. JP 2005-336595 A (Patent Document 1) proposes a stainless steel pipe having high strength and having carbon dioxide gas corrosion resistance in high-temperature environments at 230° C. The chemical composition of this steel pipe includes 15.5 to 18% Cr, 1.5 to 5% Ni, and 1 to 3.5% Mo, satisfies $Cr+0.65Ni+0.6Mo+0.55Cu-20C \geq 19.5$ and satisfies $Cr+Mo+0.3Si-43.5C-0.4Mn-Ni-0.3Cu-9N \geq 11.5$. The metal structure of this steel pipe contains 10 to 60% ferrite and 30% or less austenite, the balance being martensite.

WO 2010/050519 A (Patent Document 2) proposes a stainless steel pipe having corrosion resistance in high-temperature carbon dioxide gas environments at 200° C. and having high sulfide stress corrosion cracking resistance even when the environment temperature in the oil well or gas well falls after removal of oil or gas is temporarily stopped. The chemical composition of this steel pipe includes more than 16% to 18% Cr, more than 2% to 3% Mo, 1 to 3.5% Cu and 3 to less than 5% Ni, and satisfies $[Mn] \times ([N]-0.0045) \leq 0.001$. The metal structure of this steel pipe contains, by volume ratio, 10 to 40% ferrite and 10% or less retained austenite, the balance being martensite.

WO 2010/134498 (Patent Document 3) proposes a high-strength stainless steel having good corrosion resistance in high-temperature environments and having good SSC resistance at room temperature. The chemical composition of this steel includes more than 16% to 18% Cr, 1.6 to 4.0% Mo, 1.5 to 3.0 Cu and more than 4.0 to 5.6% Ni, satisfies $Cr+Cu+Ni+Mo \geq 25.5$, and satisfies $-8 \leq 30(C+N)+0.5Mn+Ni+Cu/2+8.2-1.1(Cr+Mo) \leq -4$. The metal structure of this steel contains martensite, 10 to 40% ferrite, and retained austenite, where the ferrite distribution ratio is higher than 85%.

In high Cr stainless steels containing 15.5 to 18% Cr disclosed in these documents, the low-temperature toughness may often be insufficient. JP 2010-209402 A (Patent Document 4) proposes a high-strength stainless steel pipe for an oil well with good low-temperature toughness. This steel pipe contains 15.5 to 17.5% Cr, where the distance between any two points in the largest crystal grain in the microstructure is not higher than 200 μm (in other words, the crystal grain diameter is not larger than 200 μm). Further, WO 2013/179667 (Patent Document 5) describes that a steel has both good corrosion resistance and good low-temperature toughness if it has a microstructure in which the GSI value, which is defined as the number of ferrite-martensite grain boundaries present per unit length along a line segment extending in the wall-thickness direction.

DISCLOSURE OF THE INVENTION

However, when toughness is evaluated in connection with fracture appearance transition temperature, even these techniques may not achieve a sufficient low-temperature toughness. Particularly, this problem is significant when the wall thickness is large.

An object of the present invention is to provide a stainless steel and a stainless steel product for an oil well having high strength and exhibiting good stress corrosion cracking resistance (SCC resistance) at high temperatures and good sulfide stress corrosion cracking resistance (SSC resistance) at room temperature as well as good low-temperature toughness.

A stainless steel according to an embodiment of the present invention has a chemical composition including, in mass %; C: 0.001 to 0.06% Si: 0.05 to 0.5%; Mn: 0.01 to 2.0%; P: up to 0.03%; S: less than 0.005% Cr: 15.5 to 18.0%; Ni: 2.5 to 6.0%; V: 0.005 to 0.25%; Al: up to 0.05%; N: up to 0.06%; O: up to 0.01%; Cu: 0 to 3.5%; Co: 0 to 1.5%; Nb: 0 to 0.25%; Ti: 0 to 0.25%; Zr: 0 to 0.25%; Ta: 0 to 0.25%; B: 0 to 0.005%; Ca: 0 to 0.01%; Mg: 0 to 0.01%; and REM: 0 to 0.05%, further including one or two selected from the group consisting of: Mo: 0 to 3.5%; and W: 0 to 3.5% in an amount that satisfies Equation (1), the balance being Fe and impurities. The stainless steel has a matrix structure having, by volume ratio, 40 to 80% tempered martensite, 10 to 50% ferrite and 1 to 15% austenite. When a microstructure image with dimensions of 1 mm×1 mm obtained by photographing the matrix structure at a magnification of 100 times is positioned in an x-y coordinate system with an x-axis formed by a wall-thickness direction and a y-axis formed by a length direction and each of 1024×1024 pixels is represented by a gray scale level, β defined by Equation (2) is not smaller than 1.55:

$$1.0 \leq Mo+0.5W \leq 3.5 \quad (1).$$

Here, Mo and W are the Mo and W contents in mass %.

[Formula 1]

$$\beta = \frac{Su}{Sv} \quad (2)$$

In Equation (2), Su is defined by Equation (3), and Sv is defined by Equation (4):

[Formula 2]

$$Su = \sum_{u=1}^{1023} \|F(u, 0)\| \tag{3}$$

$$Sv = \sum_{v=1}^{1023} \|F(0, v)\| \tag{4}$$

In Equations (3) and (4), F(u,v) is defined by Equation (5):

[Formula 3]

$$F(u, v) = \sum_{x=0}^{1023} \sum_{y=0}^{1023} f(x, y) \exp\left\{-2\pi i\left(\frac{ux}{1024} + \frac{vy}{1024}\right)\right\} \tag{5}$$

In Equation (5), f(x,y) represents the gray level of the pixel at coordinates (x,y).

The stainless steel and stainless steel product for an oil well according to the present invention have high strength, good SCC resistance at high temperatures and good SSC resistance at room temperature, and good low-temperature toughness.

EMBODIMENTS FOR CARRYING OUT THE INVENTION

To solve the above problems, the present inventors investigated conditions relating to low-temperature toughness. The present inventors arrived at the following findings.

The matrix structure of a stainless steel includes ferrite and tempered martensite and austenite (hereinafter referred to as substantially martensitic phase). If, in the matrix structure, the ferritic phase and the substantially martensitic phase extend in the rolling direction (i.e. length direction) and are arranged in a layered manner, the stainless steel has good low-temperature toughness. On the other hand, if, in the matrix structure, the ferritic phase is randomly distributed in a grid manner, the stainless steel has low low-temperature toughness. If the stainless steel is a steel plate, rolling direction is defined by the central axis of the steel plate extended by the rolling. If the stainless steel is a steel pipe, rolling direction is defined by the central axis of the steel pipe.

The present inventors found that the degree of layeredness of the microstructure which represents the ferritic phase and substantially martensitic phase in the stainless steel extending long in the length direction can be evaluated and quantized in terms of both the wall-thickness direction and length direction by performing two-dimensional discrete Fourier transform on a microstructure image. This point will be discussed in further detail below.

Figure 1:
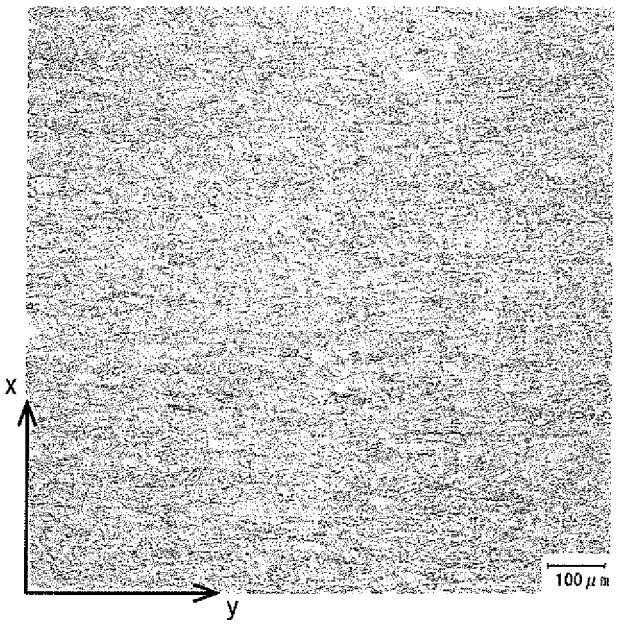
FIG. 1 is a microstructure image showing an example of a microstructure of a stainless steel in an embodiment of the present invention.

A microstructure image with dimensions of 1 mm×1 mm at an observation magnification of 100 times is taken of a cut surface perpendicular to an arbitrary plate-width direction of a stainless steel by picturing it by optical microscopy and rendering it using gray scale (256 levels). One example of a microstructure image is shown in FIG. 1. In FIG. 1, the microstructure image is positioned in an x-y coordinate system. The y-axis in FIG. 1 represents the length direction while the x-axis represents the wall-thickness direction, perpendicular to the length direction. In FIG. 1, a gray portion represents a substantially martensitic phase, and a white portion located between grains of the substantially martensitic phase represents ferrite. The microstructure image has M=1024 pixels in a series in the x-axis direction and N=1024 pixels in a series in the y-axis direction. That is, the microstructure image has M×N=1024×1024 pixels.

From the microstructure image, two-dimensional data f(x,y) is obtained for each pixel (x,y) (x=0 to M−1, y=0 to N−1). f(x,y) represents a level in gray scale for the pixel at coordinates (x,y). A two-dimensional discrete Fourier transform (2D DFT) defined by Equation (5) is performed on the obtained two-dimensional data. M−1=1023, N−1=1023.

[Formula 4]

$$F(u, v) = \sum_{x=0}^{1023} \sum_{y=0}^{1023} f(x, y) \exp\left\{-2\pi i\left(\frac{ux}{1024} + \frac{vy}{1024}\right)\right\} \tag{5}$$

Here, F(u,v) is the two-dimensional frequency spectrum of the two-dimensional data f(x,y) after the two-dimensional discrete Fourier transform. The frequency spectrum F(u,v) is typically a complex number, and contains information about the periodicity and regularity of the two-dimensional data f(x,y). In other words, the frequency spectrum F(u,v) contains information about the periodicity and regularity of the structure of the ferritic phase and substantially martensitic phase in a microstructure image such as that shown in FIG. 1.

Figure 2:
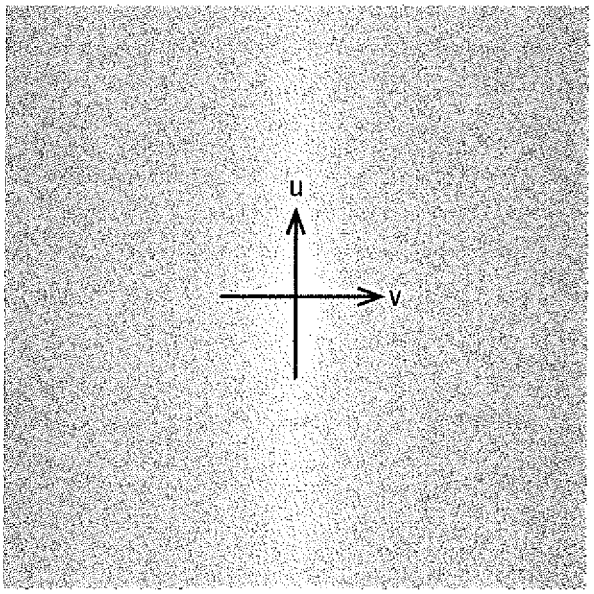
FIG. 2 is a logarithmic frequency spectrogram obtained by performing two-dimensional discrete Fourier transform on the microstructure image of FIG. 1.

FIG. 2 is a logarithmic frequency spectrogram from the microstructure image of FIG. 1. The horizontal axis of FIG. 2 forms the v-axis, while the vertical axis forms the u-axis. The frequency spectrogram of FIG. 2 is a black/white gray-level image (i.e. gray-scale image), where the maximum value of frequency spectrum is white and the minimum value is black. A portion with higher frequency spectrum values (i.e. white portion in FIG. 2) may be in a shape extending along the u-axis, as in FIG. 2, without clear borders.

In connection with the frequency spectrum F(u,v) of the frequency spectrogram, the total Su of absolute spectral values along the u-axis is defined by Equation (3). In connection with the frequency spectrum F(u,v), the total Sv of absolute spectral values along the v-axis is defined by Equation (4). Further, the ratio of Su to Sv is β defined by Equation (2). Su and Sv do not include the spectral intensity at coordinates (0,0) in the (u,v) space.

[Formula 5]

$$Su = \sum_{u=1}^{1023} \|F(u, 0)\| \quad (3)$$

$$Sv = \sum_{v=1}^{1023} \|F(0, v)\| \quad (4)$$

$$\beta = \frac{Su}{Sv} \quad (2)$$

Figure 3:
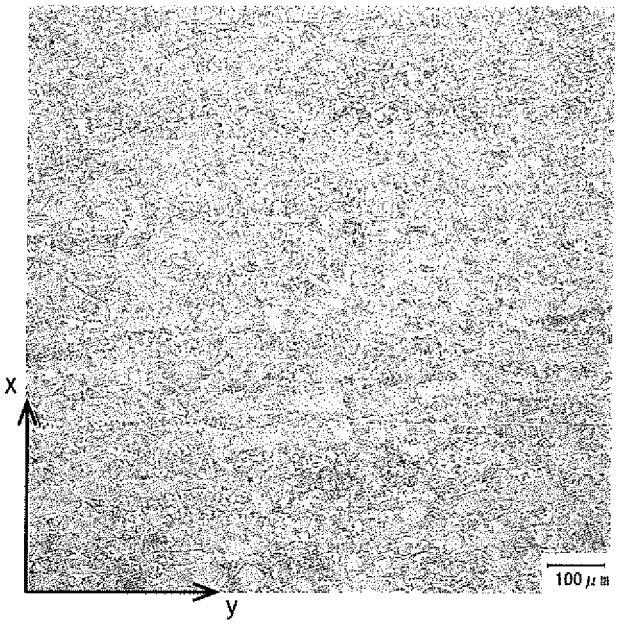
FIG. 3 is a picture showing an example of a microstructure of a stainless steel of a comparative example.
Figure 4:
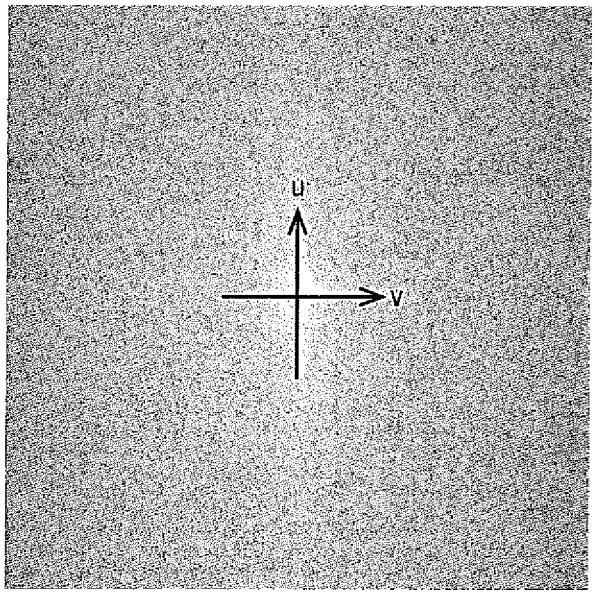
FIG. 4 is a logarithmic frequency spectrogram obtained by performing two-dimensional discrete Fourier transform on the microstructure image of FIG. 3.
Figure 5:
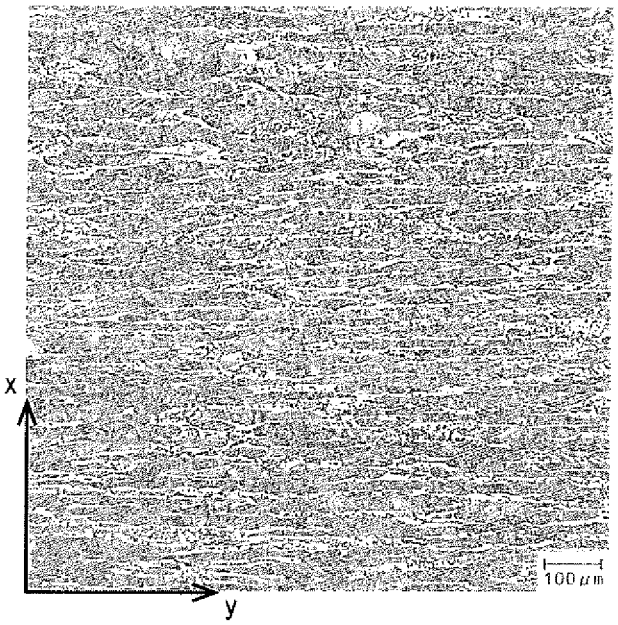
FIG. 5 is a microstructure image showing an example of a microstructure of a stainless steel in an embodiment of the present invention.
Figure 6:
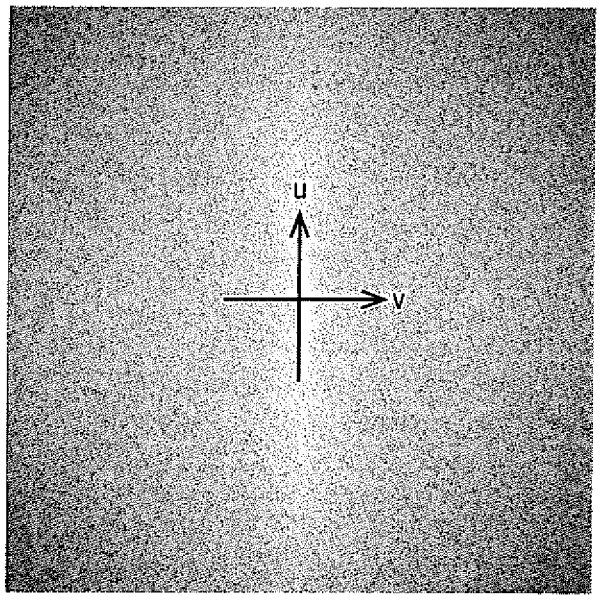
FIG. 6 is a logarithmic frequency spectrogram obtained by performing two-dimensional discrete Fourier transform on the microstructure image of FIG. 5.
Figure 7:
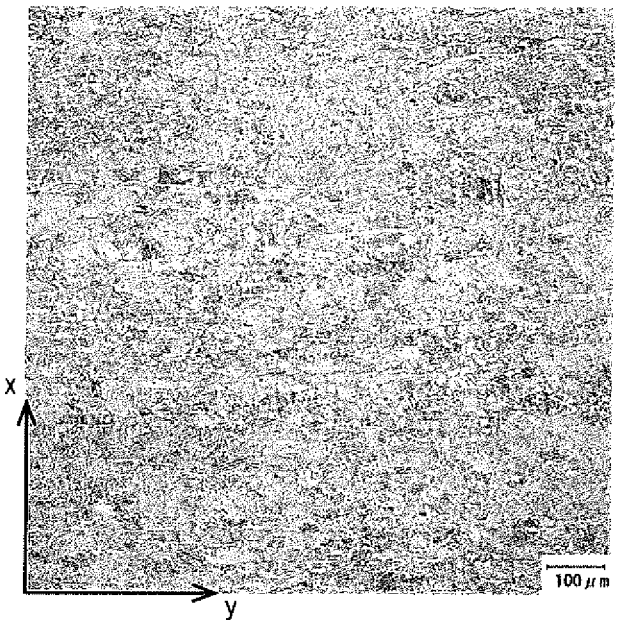
FIG. 7 is a picture showing an example of a microstructure of a stainless steel of a comparative example.
Figure 8:
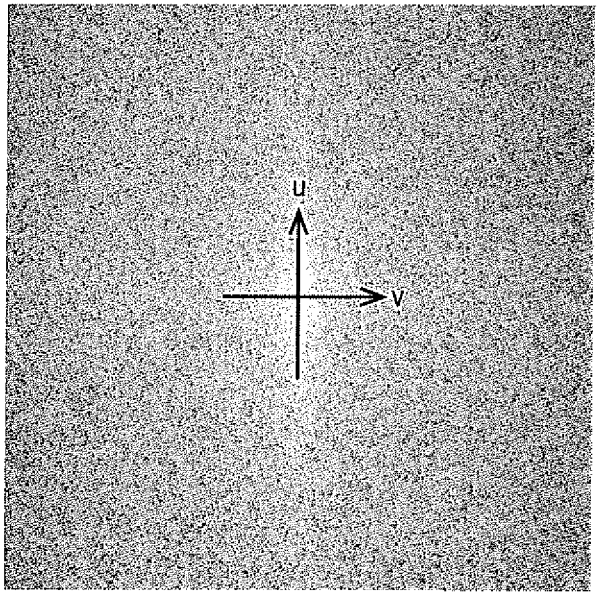
FIG. 8 is a logarithmic frequency spectrogram obtained by performing two-dimensional discrete Fourier transform on the microstructure image of FIG. 7.

Further, in a similar manner, the microstructure images of stainless steels shown in FIGS. 3, 5 and 7 are obtained. Further, from the microstructure images shown in FIGS. 3, 5 and 7, logarithmic frequency spectrograms are obtained. FIG. 4 is a logarithmic frequency spectrogram from the microstructure image of FIG. 3, FIG. 6 is a logarithmic frequency spectrogram from the microstructure image of FIG. 5, and FIG. 8 is a logarithmic frequency spectrogram from the microstructure image of FIG. 7. In the following description, the microstructure of FIG. 1 will be referred to as structure 1, the microstructure of FIG. 3 will be referred to as structure 2, the microstructure of FIG. 5 will be referred to as structure 3, and the microstructure of FIG. 7 will be referred to as structure 4.

A comparison between the image of structure 1 (FIG. 1) and the image of structure 2 (FIG. 3) shows that structure 1 has a ferritic phase and substantially martensitic phase extending along the rolling direction (i.e. length direction) compared with structure 2. Further, in structure 1, the lamination period of the ferritic phase and substantially martensitic phase (i.e. period in which they are arranged in the wall-thickness direction) is shorter than in structure 2, and these phases are more regular. A comparison between the image of structure 1 and the image of structure 3 (FIG. 5) shows that both structures 1 and 3 have each phase extending along the length direction. Further, similar to structure 1, structure 3 has a shorter lamination period and more regular phases. A comparison between the image of structure 3 and the image of structure 4 (FIG. 7) shows that structure 3 has each phase extending along the length direction compared with structure 4. Further, structure 3 has a shorter lamination period and more regular phases than structure 4.

Further, in each of the logarithmic frequency spectrograms of structures 1 to 4, a white portion extends along the u-axis. However, in structures 1 and 3, the width of the white portion, measured in the v-axis direction, is smaller than in structures 2 and 4. The value of β is 2.024 in structure 1, 1.458 in structure 2, 2.183 in structure 3, and 1.395 in structure 4. In short, as the value of β decreases, the white portion becomes shorter as measured in the u-axis direction and broader as measured in the v-axis direction.

Figure 9:
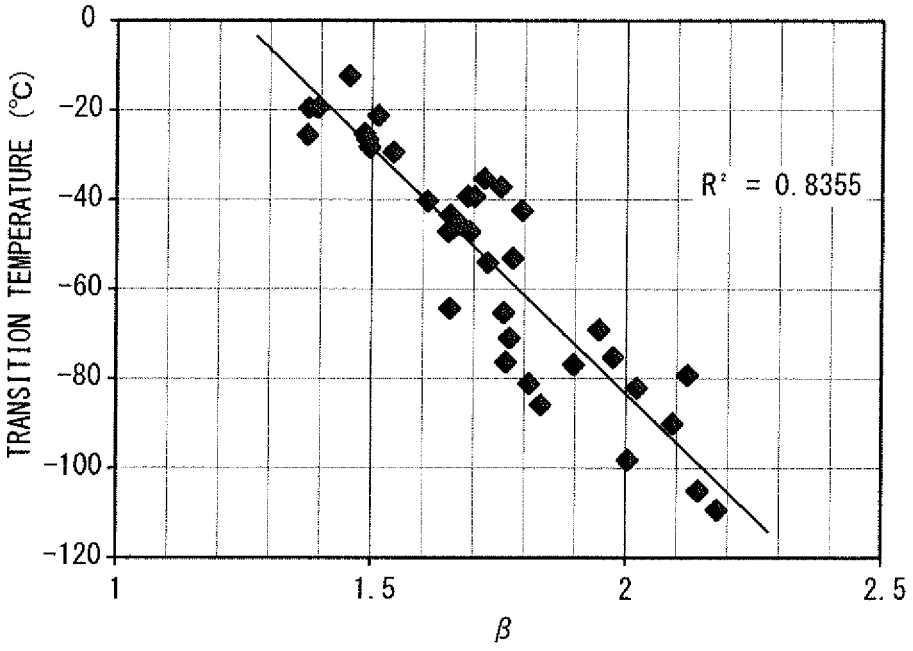
FIG. 9 is a graph illustrating the relationship between β and the transition temperature for ductile brittleness.

Further, the transition temperature for ductile brittleness is −82° C. in structure 1, −12° C. in structure 2, −109° C. in structure 3, and −19° C. in structure 4. The values of transition temperature results from conditions similar to those for the Examples described further below. FIG. 9 is a graph illustrating the relationship between β and the transition temperature (° C.). FIG. 9 was created by the following procedure: A plurality of stainless steels with chemical compositions within the ranges of the present embodiment described below and with different values of β were produced. For each stainless steel, the low-temperature toughness evaluation test described below was conducted to obtain a transition temperature value, and FIG. 9 was created based on these values. The straight line in FIG. 9 was obtained by the method of least squares from all the plot points in FIG. 9, where $R^2$ is a correlation function.

Thus, it was found that the larger the value of β, the better the low-temperature toughness tends to be. Consequently, β can be regarded as indicative of the degree of layeredness.

β may be increased by hot rolling the steel material with a large fraction of austenite at the temperature for hot rolling and with a high reduction of sectional area. The fraction of austenite at the temperature for hot rolling may be increased by adjusting the chemical composition of the steel material or lowering the temperature of the hot rolling. However, if the temperature for hot rolling is too low, hot workability decreases, which may cause flaws on the surface of the steel material. Also, there is a limit to the increase of the reduction of sectional area.

The chemical composition may be adjusted to increase the fraction of austenite at the temperature for hot rolling by increasing the contents of austenite-forming elements such as C, Ni, Cu and Co or reducing the contents of ferrite-forming elements such as Si, Cr, V, Mo and W. It is particularly effective to increase the Ni content. This makes β equal to or greater than 1.55 while the rolling temperature and reduction of sectional area are in a parctical range. On the other hand, if the chemical composition is adjusted to increase the fraction of austenite at the temperature for hot rolling, the fraction of austenite at room temperature, i.e. the amount of retained austenite tends to be large. This makes it difficult to provide a required strength.

After further research, the present inventors found that it is effective if V is contained in the steel material. As discussed above, V is a ferrite-forming element, and is thus disadvantageous when the fraction of austenite at the temperature for hot rolling is to be increased. On the other hand, V increases temper softening resistance to improve the strength of the steel. An appropriate V content makes it possible to make β equal to or greater than 1.55 and, at the same time, provide a required strength.

The present inventors made the present invention based on the above-described findings. First, a summary of an embodiment of the present invention will be provided.

A stainless steel according to an embodiment of the present invention has a chemical composition including, in mass %; C: 0.001 to 0.06%; Si: 0.05 to 0.5%; Mn: 0.01 to 2.0%; P: up to 0.03%; S: less than 0.005%; Cr: 15.5 to 18.0%; Ni: 2.5 to 6.0%; V: 0.005 to 0.25%; Al: up to 0.05%; N: up to 0.06%; O: up to 0.01%; Cu: 0 to 3.5%; Co: 0 to 1.5%; Nb: 0 to 0.25%; Ti: 0 to 0.25%; Zr: 0 to 0.25%; Ta; 0 to 0.25%; B: 0 to 0.005%; Ca: 0 to 0.01%; Mg: 0 to 0.01%; and REM: 0 to 0.05%. It further includes one or two selected from the group consisting of: Mo: 0 to 3.5%; and W: 0 to 3.5% in an amount that satisfies Equation (1). The balance is Fe and impurities. The stainless steel has a matrix structure having, by volume ratio, 40 to 80% tempered martensite, 10 to 50% ferrite and 1 to 15% austenite. When a microstructure image with dimensions of 1 mm×1 mm obtained by photographing the matrix structure at a magnification of 100 times is positioned in an x-y coordinate system with an x-axis extending in a wall-thickness direction and a y-axis extending in a length direction and each of 1024×1024 pixels is represented by a gray scale level, β defined by Equation (2) is not smaller than 1.55:

$$1.0 \leq Mo+0.5W \leq 3.5 \quad (1).$$

Here, Mo and W are the Mo and W contents in mass %.

[Formula 6]

$$\beta = \frac{Su}{Sv} \quad (2)$$

In Equation (2), Su is defined by Equation (3), and Sv is defined by Equation (4):

[Formula 7]

$$Su = \sum_{u=1}^{1023} \|F(u, 0)\| \quad (3)$$

$$Sv = \sum_{v=1}^{1023} \|F(0, v)\| \quad (4)$$

In Equations (3) and (4), F(u,v) is defined by Equation (5):

[Formula 8]

$$F(u, v) = \sum_{x=0}^{1023} \sum_{y=0}^{1023} f(x, y) \exp\left\{-2\pi i\left(\frac{ux}{1024} + \frac{vy}{1024}\right)\right\} \quad (5)$$

In Equation (5), f(x,y) represents the gray level of the pixel at coordinates (x,y).

In this stainless steel, β is not lower than 1.55 such that the transition temperature for ductile brittleness is not higher than −30° C. As a result, this stainless steel has good low-temperature toughness. Further, this stainless steel has high strength and good SCC resistance at high temperatures and good SSC resistance at room temperature.

The chemical composition of the stainless steel in an embodiment of the present invention may include one or two selected from the group consisting of, in mass %: Cu: 0.2 to 3.5%; and Co: 0.05 to 1.5%.

The chemical composition of the stainless steel in an embodiment of the present invention may include one or more selected from the group consisting of, in mass %: Nb: 0.01 to 0.25%; Ti: 0.01 to 0.25%; Zr: 0.01 to 0.25%; and Ta: 0.01 to 0.25%.

The chemical composition of the stainless steel in an embodiment of the present invention may include one or more selected from the group consisting of, in mass %; B: 0.0003 to 0.005%; Ca: 0.0005 to 0.01%; Mg: 0.0005 to 0.01%; and REM: 0.0005 to 0.05%.

Preferably, the stainless steel in an embodiment of the present invention is used as a steel product for an oil well.

[Chemical Composition]

The stainless steel in an embodiment of the present invention has the chemical composition described below. In the description below, "%" for an element means mass percentage.

C: 0.001 to 0.06%

Carbon (C) increases the strength of steel. However, if the C content is too high, the hardness after tempering is too high, decreasing SSC resistance. Further, in the chemical composition of the present embodiment, the Ms point falls as the C content increases. As such, as the C content increases, austenite tends to increase and yield strength tends to decrease. In view of this, the C content should be not higher than 0.06%. The C content is preferably not higher than 0.05%, and more preferably not higher than 0.03%. Further, when the costs associated with the decarburization step in the steel-making process are considered, the C content should be not lower than 0.001%. The C content is preferably not lower than 0.003%, and more preferably not lower than 0.005%.

Si: 0.05 to 0.5%

Silicon (Si) deoxidizes steel. However, if the Si content is too high, the toughness and hot workability of the steel decrease. Further, if the Si content is too high, the amount of ferrite produced increases and yield strength tends to decrease. Further, it becomes difficult to increase β. In view of this, the Si content should be in the range of 0.05 to 0.5%. The Si content is preferably lower than 0.5%, and more preferably not higher than 0.4%. The Si content is preferably not lower than 0.06%, and more preferably not lower than 0.07%.

Mn: 0.01 to 2.0%

Manganese (Mn) deoxidizes and desulfurizes steel, increasing hot workability. These effects are not sufficiently present if the Mn content is too low. On the other hand, if the Mn content is too high, excess austenite tends to remain during quenching, making it difficult to maintain the strength of the steel. In view of this, the Mn content should be in the range of 0.01 to 2.0%. The Mn content is preferably not higher than 1.0%, and more preferably not higher than 0.6%. The Mn content is preferably not lower than 0.02%, and more preferably not lower than 0.04%.

P: Up to 0.03%

Phosphorus (P) is an impurity. P decreases the SSC resistance of steel. Thus, the lower the P content, the better. The P content should be not higher than 0.03%. The P content is preferably not higher than 0.028%, and more preferably not higher than 0.025%. Although it is preferable to reduce the P content to the lowest possible level, reducing it excessively leads to increased steel-making costs. Thus, the P content is preferably not lower than 0.0005%, and more preferably not lower than 0.0008%.

S: Lower than 0.005%

Sulfur (S) is an impurity. S decreases the hot workability of steel. Thus, the lower the S content, the better. The S content should be lower than 0.005%. The S content is preferably not higher than 0.003%, and more preferably not higher than 0.0015%. Although it is preferable to reduce the S content to the lowest possible level, reducing it excessively leads to increased steel-making costs. Thus, the S content is preferably not lower than 0.0001%, and more preferably not lower than 0.0003%.

Cr: 15.5 to 18.0%

Chromium (Cr) increases the corrosion resistance of steel. More specifically, Cr decreases the corrosion rate, thereby increasing the SCC resistance of the steel. These effects are not sufficiently present if the Cr content is too low. On the other hand, if the Cr content is too high, the volume ratio of ferrite in the steel increases, decreasing the strength of the steel. Further, it becomes difficult to increase β. In view of this, the Cr content should be in the range of 15.5 to 18.0%. The Cr content is preferably not higher than 17.8%, and more preferably not higher than 17.5%. The Cr content is preferably not lower than 16.0%, and more preferably not lower than 16.3%.

Ni: 2.5 to 6.0%

Nickel (Ni) increases the toughness of steel. Further, Ni increases the strength of the steel. Ni increases the fraction of austenite at temperatures for hot working and contributes to increasing β. These effects are not sufficiently present if the Ni content is too low. On the other hand, if the Ni content is too high, a large amount of retained austenite tends to be produced, decreasing the strength of the steel. In view of this, the Ni content should be in the range of 2.5 to 6.0%. The Ni content is preferably lower than 6.0%, and more preferably not higher than 5.9%. The Ni content is preferably not lower than 3.0%, and more preferably not lower than 3.5%.

V: 0.005 to 0.25%

Vanadium (V) increases the strength of steel. If the V content is lower than 0.005%, a required strength cannot be provided. However, if the V content is too high, toughness decreases. Further, it becomes difficult to increase β. In view of this, the V content should be in the range of 0.005 to 0.25%. The V content is preferably not higher than 0.20%, and more preferably not higher than 0.15%. The V content is preferably not lower than 0.008%, and more preferably not lower than 0.01%.

Al: Up to 0.05%

Aluminum (Al) deoxidizes steel. However, if the Al content is too high, inclusions in the steel increase, decreasing the toughness of the steel. In view of this, the upper limit should be 0.05%. The Al content is preferably not higher than 0.048%, and more preferably not higher than 0.045%. The Al content is preferably not lower than 0.0005%, and more preferably not lower than 0.001%.

N: Up to 0.06%

Nitrogen (N) increases the strength of steel. However, if the N content is too high, excess austenite is produced, increasing inclusions in the steel. As a result, the toughness of the steel decreases. In view of this, the N content should be not higher than 0.06%. The N content is preferably not higher than 0.05%, and more preferably not higher than 0.03%. Although it is preferable to reduce the N content to the lowest possible level, reducing it excessively leads to increased steelmaking costs. Thus, the N content is preferably not lower than 0.001%, and more preferably not lower than 0.002%.

O: Up to 0.01%

Oxygen (O) is an impurity. O decreases the toughness and corrosion resistance of steel. In view of this, the O content should be not higher than 0.01%. The O content is preferably lower than 0.01%, and more preferably not higher than 0.009%, and still more preferably not higher than 0.006%. Although it is preferable to reduce the O content to the lowest possible level, reducing it excessively leads to increased steel-making costs. Thus, the O content is preferably not lower than 0.0001%, and more preferably not lower than 0.0003%.

Mo: 0 to 3.5%, W: 0 to 3.5%

Molybdenum (Mo) and tungsten (W) are replaceable with each other, i.e. both of them may be contained or one of them may be contained. At least one of Mo and W must be contained. These elements increase the SCC resistance of the steel. On the other hand, if the contents of these elements are too high, the steel is saturated with them with respect to their effects, and it becomes difficult to increase β, as well. In view of this, the Mo content should be in the range of 0 to 3.5%, and the W content should be in the range of 0 to 3.5%, and one or two selected from the group consisting of Mo and W must be contained in an amount that satisfies Equation (1). The Mo content is preferably not higher than 3.3%, and more preferably not higher than 3.0%. The Mo content is preferably not lower than 0.01%, and more preferably not higher than 0.03%. The W content is preferably not higher than 3.3%, and more preferably not higher than 3.0%. The W content is preferably not lower than 0.01%, and more preferably not lower than 0.03%.

$$1.0 \leq Mo+0.5W \leq 3.5 \quad (1).$$

The chemical composition of the stainless steel in the present embodiment may contain one or more of the optional elements listed below. That is, each of the elements below does not have to be contained in the stainless steel in the present embodiment. Only some of them may be contained.

Cu: 0 to 3.5%, Co: 0 to 1.5%

Copper (Cu) and Cobalt (Co) are replaceable with each other. These elements are optional. These elements increase the volume fraction of tempered martensite, increasing the strength of the steel. Further, Cu contributes to increasing β. Further, during tempering, Cu precipitates in the form of Cu particles, further increasing the strength. These effects are not sufficiently present if the contents of these elements are too low. On the other hand, if the contents of these elements are too high, the hot workability of the steel decreases. In view of this, the Cu content should be in the range of 0 to 3.5%, and the Co content should be in the range of 0 to 1.5%. Further, it is preferable to include one or two selected from the group consisting of 0.2 to 3.5% Cu and 0.05 to 1.5% Co in order that the above-described effects are sufficiently present. The Cu content is preferably not higher than 3.3%, and more preferably not higher than 3.0%. The Cu content is preferably not lower than 0.3%, and more preferably not lower than 0.5%. The Co content is preferably not higher than 1.0%, and more preferably not higher than 0.8%. The Co content is preferably not lower than 0.08%, and more preferably not lower than 0.1%.

Nb: 0 to 0.25%, Ti: 0 to 0.25%, Zr: 0 to 0.25% and Ta: 0 to 0.25%

Niobium (Nb), titanium (Ti), zirconium (Zr) and tantalum (Ta) are replaceable with each other. These elements are optional. These elements increase the strength of steel. These elements improve the pitting resistance and SCC resistance of the steel. These effects are present if these elements are contained in a small amount. However, if the contents of these elements are too high, the toughness of the steel decreases. In view of this, the Nb content should be in the range of 0 to 0.25%, the Ti content in the range of 0 to 0.25%, the Zr content in the range of 0 to 0.25%, and the Ta content in the range of 0 to 0.25%. Further, it is preferable to include one or more selected from the group consisting of 0.01 to 0.25% Nb, 0.01 to 0.25% Ti, 0.01 to 0.25% Zr, and 0.01 to 0.25% Ta in order that the above-described effects are sufficiently present. The Nb content is preferably not higher than 0.23%, and more preferably not higher than 0.20%. The Nb content is preferably not lower than 0.02%, and more preferably not lower than 0.05%. The Ti content is preferably not higher than 0.23%, and more preferably not higher than 0.20%. The Ti content is preferably not lower than 0.02%, and more preferably not lower than 0.05%. The Zr content is preferably not higher than 0.23%, and more preferably not higher than 0.20%. The Zr content is preferably not lower than 0.02%, and more preferably not lower than 0.05%. The Ta content is preferably not higher than 024%, and more preferably not higher than 0.23%. The Ta content is preferably not lower than 0.02%, and more preferably not lower than 0.05%.

Ca: 0 to 0.01%, Mg: 0 to 0.01%, REM: 0 to 0.05% and B: 0 to 0.005%

Calcium (Ca), magnesium (Mg), rare-earth elements (REMs) and boron (B) are replaceable with each other. These elements are optional. These elements improve the hot workability of steel being produced. The above-described effects are present to some degree if these elements are contained in a small amount. However, if the contents of Ca, Mg and REMs are too high, they bond to oxygen to significantly decrease the cleanliness of the resulting alloy, deteriorating SSC resistance. If the B content is too high, the toughness of the steel decreases. In view of this, the Ca content should be in the range of 0 to 0.01%, the Mg content in the range of 0 to 0.01%, the REM content in the range of 0 to 0.05%, and the B content in the range of 0 to 0.005%. It is preferable to include one or more selected from the group consisting of 0.0005 to 0.01% Ca, 0.0005 to 0.01% Mg, 0.0005 to 0.05% REM and 0.0003 to 0.005% B in order that the above-described effects are sufficiently present. The Ca content is preferably not higher than 0.008%, and more preferably not higher than 0.005%. The Ca content is preferably not lower than 0.0008%, and more preferably not lower than 0.001%. The Mg content is preferably not higher than 0.008%, and more preferably not higher than 0.005%. The Mg content is preferably not lower than 0.0008%, and more preferably not lower than 0.001%. The REM content is preferably not higher than 0.045%, and more preferably not higher than 0.04%. The REM content is preferably not lower than 0.0008%, and more preferably not lower than 0.001%. The B content is preferably not higher than 0.0045%, and more preferably not higher than 0.004%. The B content is preferably not lower than 0.0005%, and more preferably not lower than 0.0008%.

REM is a general term for a total of 17 elements, i.e. scandium (Sc), yttrium (Y) and lanthanoids. In the present embodiment, REM content means the total content of one or more of these 17 elements.

The balance of the chemical composition of the stainless steel in the present embodiment is Fe and impurities. Impurity as used herein means an element originating from ore or scraps used as a raw material of a stainless steel being manufactured on an industrial basis or an element that has entered from the environment or the like during the manufacturing process.

[Microstructure]

The matrix structure of the stainless steel in the present embodiment has, in volume ratio, 40 to 80% tempered martensite, 10 to 50% ferrite, and 1 to 15% austenite. In the following description, "%" for the volume ratios (or fractions) for the matrix structure means volume percentage.

If the volume ratio of tempered martensite is too low, a required strength cannot be provided. On the other hand, if the fraction of tempered martensite is too high, a required corrosion resistance and toughness cannot be provided. The lower limit of the volume ratio of tempered martensite is preferably 45%, and more preferably 50%. The upper limit of the volume ratio of tempered martensite is preferably 75%, and more preferably 70%.

If the volume ratio of ferrite is too low, a required corrosion resistance cannot be provided. On the other hand, if the volume ratio of ferrite is too high, a required strength and toughness cannot be provided. The lower limit of the volume ratio of ferrite is preferably 15%, and more preferably 20%. The upper limit of the volume ratio of ferrite is preferably 45%, and more preferably 40%.

If the volume ratio of austenite is too low, a required toughness cannot be provided. On the other hand, if the volume ratio of austenite is too high, a required strength cannot be provided. The lower limit of the volume ratio of austenite is preferably 1.5%, and more preferably 2%. The upper limit of the volume ratio of austenite is preferably 12%, and more preferably 10%.

If the contents of austenite-forming elements such as C, Ni, Cu and Co are increased, the volume ratios of tempered martensite and austenite increase and the volume ratio of ferrite decreases. If the contents of ferrite-forming elements such as Si, Cr, V, Mo and W are increased, the volume ratio of ferrite increases and the volume ratios of tempered martensite and austenite decrease.

The volume ratio of ferrite in the matrix structure (i.e. ferrite fraction, in %), the volume ratio of austenite (i.e. austenite fraction, in %) and the volume ratio of tempered martensite (i.e. martensite fraction, in %) are measured by the following procedure.

[Method of Measuring Ferrite Fraction]

A sample is extracted from an arbitrary location in a stainless steel. The surface of the sample that corresponds to a cut surface of the stainless steel (hereinafter referred to as observed surface) is polished. A mixed solution of aqua regia and glycerin is used to etch the observed surface that has been polished. The portions that have been etched and become white constitute a ferritic phase, and the area ratio of this ferritic phase is measured by point counting in accordance with JIS G0555 (2003). Since it is assumed that the measured area ratio is equal to the volume fraction of the ferritic phase, ferrite fraction (%) is defined as such an area ratio.

[Method of Measuring Austenite Fraction]

Austenite fraction is determined using the X-ray diffraction method. A sample with dimensions of 15 mm×15 mm×2 nun is extracted from an arbitrary location of a stainless steel. With this sample, the X-ray intensities for the (200) and (211) planes of the ferritic phase (α phase) and the (200), (220) and (311) planes of the austenitic phase (γ phase) are measured and the integrated intensity for each plane is calculated. After calculation, for each of a total of 6 combinations of a plane of the α phase and a plane of the γ phase, Equation (6) provided below is used to determine the volume ratio Vγ. Austenite fraction (%) is defined as the average of the volume ratios Vγ for these planes.

$$V\gamma=100/\{1+(I\alpha\times R\gamma)/(I\gamma\times R\alpha)\} \quad (6).$$

Here, Iα is the integrated intensity for the α phase, Rγ is the crystallographic theoretical calculated value for the γ phase, Iγ is the integrated intensity for the γ phase, and Rα is the crystallographic theoretical calculated value for the α phase.

[Method of Measuring Martensite Fraction]

Volume ratio of the tempered martensitic phase (i.e. martensite fraction) is defined as the volume ratio of the remainder of the matrix structure, i.e. the portion thereof other than ferrite and austenite. That is, the martensite fraction (%) is obtained by subtracting the ferrite fraction (%) and austenite fraction (%) from 100%

[β]

The stainless steel in the present embodiment has a value of β defined by Equation (2) that is equal to or larger than 1.55. β is calculated by the following procedure. A matrix structure on a cut surface perpendicular to an arbitrary plate-width direction of a stainless steel (for a steel pipe, a cut surface in the wall thickness parallel to the pipe axis) is photographed at a magnification of 100 times. The obtained microstructure image with dimensions of 1 mm×1 mm is positioned in an x-y coordinate system with an x-axis extending in the wall-thickness direction and a y-axis extending in the length direction, and each of 1024×1024 pixels is represented by a gray scale level. Thus, a microstructure image represented in gray scale (with 256 levels) is obtained from a cut surface of the stainless steel that includes the wall-thickness direction and length direction. Further, two-dimensional discrete Fourier transform is used to calculate β defined by Equation (2) based on the microstructure image represented in gray scale.

[Formula 9]

$$\beta = \frac{Su}{Sv} \tag{2}$$

In Equation (2), Su is defined by Equation (3), and Sv is defined by Equation (4).

[Formula 10]

$$Su = \sum_{u=1}^{1023} \|F(u, 0)\| \tag{3}$$

$$Sv = \sum_{v=1}^{1023} \|F(0, v)\| \tag{4}$$

In Equations (3) and (4), F(u,v) is defined by Equation (5).

[Formula 11]

$$F(u, v) = \sum_{x=0}^{1023} \sum_{y=0}^{1023} f(x, y)\exp\left\{-2\pi i\left(\frac{ux}{1024} + \frac{vy}{1024}\right)\right\} \tag{5}$$

In Equation (5), f(x,y) represents the gray level of the pixel at coordinates (x,y).

Thus, β and low-temperature toughness are in the relationship shown in FIG. 9. In the stainless steel according to an embodiment of the present invention, the transition temperature for ductile brittleness is not higher than −30° C., as shown in FIG. 9, if the value of β calculated from a matrix structure is not lower than 1.55. Thus, the stainless steel in an embodiment of the present invention has good low-temperature toughness at −10° C., to which temperature the steel is typically required to be exposed. The value of β is preferably not lower than 1.6, and more preferably not lower than 1.65.

β is dependent on the austenite fraction at temperatures for hot working and the reduction of sectional area. The higher the austenite fraction at temperatures for hot working and the higher the reduction of sectional area, the greater β becomes. The austenite fraction at temperatures for hot working may be increased by increasing the contents of austenite-forming elements such as C, Ni, Cu and Co or reducing the contents of ferrite-forming elements such as Si, Cr, V, Mo and W. Or, hot working may be performed at lower temperatures.

Thus, the stainless steel in an embodiment of the present invention has high strength and good SCC resistance at high temperatures and good SSC resistance at room temperature, and has good low-temperature toughness. Preferably, the stainless steel in the present embodiment is used as a stainless steel product for an oil well.

Preferably, the stainless steel according to the present embodiment has a yield strength not lower than 758 MPa. More preferably, the stainless steel according to the present embodiment has a yield strength not lower than 800 MPa.

Preferably, the stainless steel according to the present embodiment has a transition temperature for ductile brittleness not higher than −30° C. More preferably, the stainless steel according to the present embodiment has a transition temperature for ductile brittleness not higher than −35° C.

[Manufacturing Method]

An example of a method of manufacturing the stainless steel in the present embodiment will be described. A matrix structure with a value of β not lower than 1.55 will be obtained if a steel material having the above-described chemical composition (slab or billet such as a slab, bloom or billet) is hot-rolled at an appropriate temperature at the highest possible reduction of sectional area. In the present implementation, as an example of a method of manufacturing a stainless steel, a method of manufacturing a stainless steel plate will be described.

A steel material having the above-described chemical composition is prepared. The material may be a slab produced by continuous casting, or a plate produced by hot-working a slab or ingot.

The prepared material is loaded into a heating furnace or soaking furnace and is heated. The heated material is hot-rolled to produce an intermediate material (i.e. steel material after hot-rolling). The reduction of sectional area during this hot-rolling step is 40% or higher. The reduction of sectional area (r in %) is defined by the following Equation (7):

$$r=\{1-(\text{wall thickness of steel material after hot rolling}/\text{wall thickness of steel material before hot rolling})\}\times 100 \tag{7}$$

The steel material temperature during hot rolling (i.e. rolling starting temperature) is in the range of 1200 to 1300° C. Steel material temperature as used herein means the temperature of the surface of the material. The temperature of the surface of the material may be measured at the time when the hot rolling begins, for example. The temperature of the surface of the material is the average of surface temperatures measured along the axial direction of the material. If the material is soaked at a heating temperature of 1250° C. in the heating furnace, for example, the steel material temperature is substantially equal to the heating temperature, i.e. 1250° C. The steel material temperature when the hot rolling ends (i.e. rolling end temperature) is preferably not lower than 1100° C.

If the manufacturing process includes a plurality of hot-rolling steps, the reduction of sectional area is the cumulative reduction for the hot-rolling steps consecutively performed on a material at steel material temperatures in the range of 1100 to 1300° C.

If the steel material temperature falls below 1100° C. during hot rolling, the resulting decrease in hot workability may produce a large number of flaws on the steel material surface. In view of this, in order to prevent flaws, the higher the heating temperature for the steel material, the better. On the other hand, it is preferable to roll the steel at low temperatures to increase the degree of layeredness (i.e. increase β).

Further, in order to increase the degree of layeredness (i.e. increase β), it is preferable to roll the steel at high reductions of sectional area.

The material plate after hot rolling (i.e. intermediate material) is quenched and tempered. Quenching and tempering the intermediate material ensures that the yield strength of the stainless steel plate is not lower than 758 MPa. Further, the matrix structure has tempered martensite and ferrite phase.

Preferably, during the quenching step, the intermediate material is cooled to a temperature close to room temperature. Then, the cooled intermediate material is heated to a temperature in the range of 850 to 1050° C. The heated intermediate material is cooled by water or the like, and is quenched to produce a stainless steel plate. Preferably, during the tempering step, the intermediate material after quenching is heated to a temperature that is not higher than 650° C. That is, the tempering temperature is preferably not higher than 650° C., because, if the tempering temperature exceeds 650° C., austenite phase retained at room temperature increases in the steel, which tends to decrease strength. Preferably, during the tempering step, the intermediate material after quenching is heated to a temperature higher than 500° C. That is, the tempering temperature is preferably higher than 500° C.

The manufacturing process described above produces a stainless steel plate with β not lower than 1.55. The stainless steel is not limited to a steel plate and may take other shapes. Preferably, the material is soaked at a temperature in the range of 1200 to 1250° C. for a predetermined period of time, and hot rolling is then performed at a reduction of sectional area not lower than 50% and at a rolling end temperature not lower than 1100° C. This will provide a stainless steel product with high degree of layeredness while preventing production of surface flaws.

EXAMPLES

Steels of steel types A to W having the chemical compositions shown in Table 1 were produced by smelting, and ingots were produced. The chemical compositions of steel types A to V are within the ranges of the present embodiment. Steel type W is a comparative example that contains no V. The ingots were hot-forged to produce plates with a width of 100 mm and a height of 30 mm. The produced plates were treated to provide steel materials of Nos. 1 to 37. In the chemical compositions shown in Table 1, the content of each element is in mass percentage and the balance is Fe and impurities.

TABLE 1

| Steel type | Chemical composition (in mass %, balance Fe and impurities) | | | | | | | | | | | | | | | | |
|---|---|---|---|---|---|---|---|---|---|---|---|---|---|---|---|---|---|
| | C | Si | Mn | P | S | Cr | Ni | V | Al | N | O | Mo | W | Cu | Co | Ti, Zr, Nb, Ta | Ca, Mg, REM, B |
| A | 0.010 | 0.26 | 0.22 | 0.015 | 0.0007 | 17.0 | 5.9 | 0.03 | 0.044 | 0.002 | 0.005 | 2.5 | — | — | — | — | — |
| B | 0.010 | 0.26 | 0.11 | 0.016 | 0.0005 | 16.9 | 4.5 | 0.04 | 0.025 | 0.002 | 0.007 | 2.5 | — | 2.5 | — | — | — |
| C | 0.010 | 0.25 | 0.10 | 0.014 | 0.0006 | 17.0 | 4.7 | 0.06 | 0.014 | 0.002 | 0.008 | 2.5 | — | 2.5 | — | — | — |
| D | 0.009 | 0.25 | 0.11 | 0.015 | 0.0006 | 17.1 | 4.8 | 0.04 | 0.029 | 0.002 | 0.008 | 1.4 | 1.9 | 2.4 | — | — | — |
| E | 0.010 | 0.25 | 0.11 | 0.014 | 0.0006 | 17.1 | 5.0 | 0.03 | 0.026 | 0.002 | 0.008 | 2.5 | — | 2.4 | — | — | — |
| F | 0.012 | 0.26 | 0.11 | 0.017 | 0.0004 | 16.9 | 5.1 | 0.03 | 0.010 | 0.007 | 0.009 | 2.1 | 0.8 | 2.5 | — | — | — |
| G | 0.010 | 0.25 | 0.10 | 0.015 | 0.0004 | 17.0 | 5.2 | 0.08 | 0.026 | 0.005 | 0.009 | 2.5 | — | 2.4 | — | — | — |
| H | 0.010 | 0.24 | 0.10 | 0.015 | 0.0005 | 17.1 | 5.4 | 0.08 | 0.020 | 0.006 | 0.009 | 2.5 | — | — | 0.4 | — | — |
| I | 0.017 | 0.13 | 0.22 | 0.014 | 0.0006 | 17.0 | 5.7 | 0.03 | 0.013 | 0.008 | 0.004 | 2.4 | — | 1.0 | — | Ti 0.11 | — |
| J | 0.012 | 0.25 | 0.20 | 0.024 | 0.0004 | 16.9 | 5.9 | 0.07 | 0.014 | 0.003 | 0.001 | 2.4 | — | 1.1 | — | Zr 0.15 | — |
| K | 0.013 | 0.36 | 0.22 | 0.019 | 0.0004 | 16.5 | 5.5 | 0.05 | 0.020 | 0.008 | 0.001 | 1.9 | 0.4 | 1.3 | — | Mb 0.13 | — |
| L | 0.011 | 0.23 | 0.15 | 0.019 | 0.0004 | 17.0 | 5.6 | 0.06 | 0.024 | 0.007 | 0.004 | 2.6 | — | 1.2 | — | Ta 0.17 | — |
| M | 0.005 | 0.36 | 0.11 | 0.014 | 0.0007 | 16.5 | 5.7 | 0.06 | 0.013 | 0.002 | 0.006 | 2.4 | — | 1.1 | — | — | Ca 0.002 |
| N | 0.012 | 0.10 | 0.05 | 0.023 | 0.0004 | 16.6 | 5.7 | 0.07 | 0.032 | 0.005 | 0.005 | 2.3 | — | 1.2 | — | — | Mg 0.003 |
| O | 0.011 | 0.38 | 0.08 | 0.018 | 0.0004 | 16.5 | 5.9 | 0.04 | 0.013 | 0.003 | 0.002 | 2.2 | — | 0.9 | — | — | REM 0.02 |
| P | 0.007 | 0.14 | 0.21 | 0.018 | 0.0005 | 16.5 | 5.5 | 0.04 | 0.025 | 0.003 | 0.003 | 2.5 | — | 1.1 | — | — | B 0.002 |
| Q | 0.022 | 0.40 | 0.15 | 0.018 | 0.0006 | 16.7 | 4.3 | 0.03 | 0.027 | 0.007 | 0.003 | 2.3 | — | 2.5 | — | Ti 0.15 | — |
| R | 0.012 | 0.16 | 0.06 | 0.016 | 0.0006 | 16.6 | 5.7 | 0.05 | 0.022 | 0.004 | 0.003 | 2.5 | — | 1.2 | 0.2 | Nb 0.18 | — |
| S | 0.013 | 0.19 | 0.15 | 0.016 | 0.0004 | 16.7 | 5.4 | 0.08 | 0.027 | 0.003 | 0.001 | 2.4 | — | 1.6 | 0.3 | — | Ca 0.003 |
| T | 0.028 | 0.13 | 0.09 | 0.014 | 0.0006 | 16.5 | 3.9 | 0.04 | 0.025 | 0.003 | 0.004 | 2.6 | — | 2.5 | — | — | B 0.002 |
| U | 0.010 | 0.37 | 0.12 | 0.024 | 0.0005 | 16.5 | 4.9 | 0.04 | 0.025 | 0.006 | 0.006 | 2.2 | — | 2.5 | — | Ti 0.14 | Ca 0.002 |
| V | 0.012 | 0.38 | 0.16 | 0.020 | 0.0006 | 16.9 | 3.6 | 0.04 | 0.025 | 0.003 | 0.004 | 2.2 | — | 3.0 | — | Nb 0.15 | REM 0.03 |
| W | 0.009 | 0.27 | 0.21 | 0.015 | 0.0006 | 17.1 | 4.8 | — | 0.041 | 0.003 | 0.007 | 2.6 | — | — | — | — | — |

The materials prepared were heated in a heating furnace. The heated materials were removed from the heating furnace and, immediately after the removal, were subjected to hot rolling to produce intermediate materials of Nos. 1 to 37. The steel material temperatures for the materials during hot rolling are shown in Table 2. In the present Examples, the materials were heated in the heating furnace for a sufficient time period such that the steel material temperatures were equal to the heating temperatures. The reductions of sectional area during hot rolling for the various numbers are shown in Table 2.

TABLE 2

| No. | Steel type | Rolling starting temperature (° C.) | Reduction of sectional area (%) | Quenching temperature (° C.) | Heat treatment time (min.) | Tempering temperature (° C.) | Quenching temperature (min.) |
|---|---|---|---|---|---|---|---|
| 1 | A | 1250 | 80 | 950 | 15 | 550 | 30 |
| 2 | B | 1250 | 40 | 950 | 15 | 600 | 30 |
| 3 | B | 1250 | 60 | 950 | 15 | 600 | 30 |
| 4 | B | 1250 | 80 | 950 | 15 | 600 | 30 |

TABLE 2-continued

| No. | Steel type | Rolling starting temperature (° C.) | Reduction of sectional area (%) | Quenching temperature (° C.) | Heat treatment time (min.) | Tempering temperature (° C.) | Quenching temperature (min.) |
|---|---|---|---|---|---|---|---|
| 5 | C | 1250 | 40 | 950 | 15 | 600 | 30 |
| 6 | C | 1250 | 60 | 950 | 15 | 600 | 30 |
| 7 | C | 1250 | 80 | 950 | 15 | 600 | 30 |
| 8 | D | 1250 | 40 | 950 | 15 | 600 | 30 |
| 9 | D | 1250 | 60 | 950 | 15 | 600 | 30 |
| 10 | D | 1250 | 80 | 950 | 15 | 600 | 30 |
| 11 | E | 1250 | 40 | 950 | 15 | 600 | 30 |
| 12 | E | 1250 | 60 | 950 | 15 | 600 | 30 |
| 13 | E | 1250 | 80 | 950 | 15 | 600 | 30 |
| 14 | F | 1250 | 40 | 950 | 15 | 600 | 30 |
| 15 | F | 1250 | 60 | 950 | 15 | 600 | 30 |
| 16 | F | 1250 | 80 | 950 | 15 | 600 | 30 |
| 17 | G | 1250 | 40 | 950 | 15 | 600 | 30 |
| 18 | G | 1250 | 60 | 950 | 15 | 600 | 30 |
| 19 | G | 1250 | 80 | 950 | 15 | 600 | 30 |
| 20 | H | 1250 | 40 | 950 | 15 | 600 | 30 |
| 21 | H | 1250 | 60 | 950 | 15 | 600 | 30 |
| 22 | H | 1250 | 80 | 950 | 15 | 600 | 30 |
| 23 | I | 1250 | 60 | 950 | 15 | 550 | 30 |
| 24 | J | 1250 | 60 | 950 | 15 | 550 | 30 |
| 25 | K | 1250 | 60 | 950 | 15 | 550 | 30 |
| 26 | L | 1250 | 60 | 950 | 15 | 550 | 30 |
| 27 | M | 1250 | 60 | 950 | 15 | 550 | 30 |
| 28 | N | 1250 | 60 | 950 | 15 | 550 | 30 |
| 29 | O | 1250 | 60 | 950 | 15 | 550 | 30 |
| 30 | P | 1250 | 60 | 950 | 15 | 550 | 30 |
| 31 | Q | 1250 | 60 | 950 | 15 | 600 | 30 |
| 32 | R | 1250 | 60 | 950 | 15 | 550 | 30 |
| 33 | S | 1250 | 60 | 950 | 15 | 550 | 30 |
| 34 | T | 1250 | 60 | 950 | 15 | 600 | 30 |
| 35 | U | 1250 | 60 | 950 | 15 | 600 | 30 |
| 36 | V | 1250 | 60 | 950 | 15 | 600 | 30 |
| 37 | W | 1250 | 60 | 950 | 15 | 550 | 30 |

The intermediate materials of Nos. 1 to 37 were quenched and tempered. The quenching temperature was 950° C. The time for which the materials were held at the quenching temperature (i.e. heat-treatment time) was 15 minutes. The intermediate materials were quenched by water cooling. The tempering temperature for the intermediate materials of Nos. 1, 23 to 30, 32, 33 and 37was 550° C., and that for the intermediate materials of Nos. 2 to 22, 31 and 34 to 36 was 600° C. The time for which the materials were held at the tempering temperature was 30 minutes. The above-described manufacturing process produced the steel plates of the various numbers.

[Microstructure Observation Test]

The steel plates of Nos. 1 to 37 were cut at the center as measured in the width along the length direction. Samples for microstructure observation were extracted from the portions of the cut surfaces (with a y-axis formed by the length direction and an x-axis formed by the wall-thickness direction) that were located at the centers of the steel plates. The area ratio was measured on each of the extracted samples by the procedure described above, and treated as the volume ratio of ferrite. Further, the volume ratio of austenite was calculated by the X-ray diffraction method described above. Further, the volume ratio of tempered martensite was calculated by the procedure described above using the volume ratio of ferrite and the volume ratio of austenite.

Further, a microstructure image of dimensions of 1 mm×1 mm at an observation magnification of 100 times (for example, the image shown in FIG. 1) was obtained from an arbitrary location on each observed surface. The obtained microstructure image was used to calculate the value of β for each of the steel plates of the various numbers by the procedure described above.

[Yield Strength Evaluation Test]

A round rod for a tensile test was extracted from the portion of each of the steel plates of Nos. 1 to 37 that was located at the center as measured in the wall-thickness direction. The longitudinal direction of the round rod was parallel to the rolling direction for the steel plate (i.e. L direction). The diameter of the parallel portion of each round rod was 6 mm, and the distance between the gauge marks was 40 mm. A tensile test was conducted for each extracted round rod in accordance with JIS Z 2241 (2011) at room temperature to determine the yield strength (0.2% proof stress).

[Low-Temperature Toughness Evaluation Test]

Charpy impact tests were conducted to evaluate toughness at low-temperatures. A full-size test specimen in accordance with ASTM E23 was extracted from the portion of each of the steel plates of Nos. 1 to 37 that was located at the center as measured in the wall-thickness direction. The longitudinal direction of the test specimens was parallel to the plate width direction. A Charpy impact test was conducted for each of the extracted test specimens at temperatures in the range of 20° C. to −120° C., and the absorbed energy (J) was measured and the ductility-brittleness transition temperature for impact absorbed energy was determined.

[High-Temperature SCC Resistance Evaluation Test]

A four-point bending test specimen was extracted from each of the steel plates of Nos. 1 to 37. The test specimens had a length of 75 mm, a width of 10 mm and a thickness of 2 mm. The test specimens were deflected by four-point bending. The amount of deflection for each test specimen was determined such that the stress applied to the test specimen was equal to the 0.2% offset proof stress of the test specimen in accordance with ASTM G 39. An autoclave at 200° C. in which $CO_2$ at 30 bar (3.0 MPa) and $H_2S$ at 0.01 bar (1 kPa) were sealed under pressure was provided for each of Nos. 1 to 36. A deflected test specimen was placed within each autoclave. In the autoclave, the test specimen was immersed for 720 hours in an NaCl solution of 25 mass %. The solution was adjusted to pH 4.5 by a $CH_3COONa$+$CH_3COOH$ buffer system containing 0.41 g/l of $CH_3COONa$. The test specimen after immersion was observed to determine whether there were stress corrosion cracks (SCC). More specifically, a cut surface of the test specimen to which the tensile stress had been applied was observed by optical microscopy at a magnification of 100 times to determine whether there were cracks. In Table 3, "○" indicates that there were no cracks and "×" indicates that there were cracks, and the test specimens with "○" had better SCC resistances than those with "×". Further, the decrease in amount due to corrosion for each test specimen was determined based on the difference between the weight before the test and the weight after the immersion. Based on the determined decrease in amount due to corrosion, the annual corrosion amount (mm/year) was calculated.

[SSC Resistance Evaluation Test at Room Temperature]

From each of the steel plates of Nos. 1 to 37, a round rod test specimen was extracted for NACE TM0177 METHOD A. The test specimen had a diameter of 6.35 mm, and a parallel portion length of 25.4 mm. A tensile stress was applied to the test specimen in its axial direction. The stress applied to the test specimen was adjusted so as to be 90% of the measured yield stress of the test specimen in accordance with NACA TM0177-2005. The test specimen was immersed for 720 hours in an NaCl solution of 25 mass % saturated with $H_2S$ at 0.01 bar (1 kPa) and $CO_2$ at 0.99 bar (0.099 MPa). The solution was adjusted to pH 4.0 by a $CH_3COONa$+$CH_3COOH$ buffer system containing 0.41 g/l of $CH_3COONa$. The temperature of the solution was adjusted to 25° C. The test specimen after immersion was observed to determine whether there were sulfide stress corrosion cracks (SSC). More specifically, those of the test specimens of Nos. 1 to 37 that broke during the test and those that did not break were examined, where the parallel portion of each test specimen was observed by the naked eye to determine whether there were cracks or pits. In Table 3, "○" indicates that there were no cracks or pits and "×" indicates that there were cracks or pits, and the test specimens with "○" had better SSC resistances than those with "×".

[Test Results]

Table 3 shows the test results. In each of the steel plates of Nos. 1 to 37, the volume ratio of ferrite (α fraction), the volume ratio of austenite (γ fraction) and the volume ratio of tempered martensite (M fraction) were within the ranges of the present embodiment. Each of the steel materials of Nos. 1 to 36 had a yield strength not less than 758 MPa, an annual corrosion amount not higher than 0.01 mm/year, and good SCC resistance and SSC resistance.

TABLE 3

| No. | Steel type | β | α fraction (%) | γ fraction (%) | M fraction (%) | Yield trength (%) | Transition temperature (° C.) | Annual corrosion amount (mm/year) | SCC resistance | SSC resistance |
|---|---|---|---|---|---|---|---|---|---|---|
| 1 | A | 2.145 | 34.8 | 9.9 | 55.3 | 824 | −105 | <0.01 | ○ | ○ |
| 2 | B | 1.458 | 31.4 | 2.9 | 65.7 | 893 | −12 | <0.01 | ○ | ○ |
| 3 | B | 1.488 | 31.4 | 2.9 | 65.7 | 888 | −25 | <0.01 | ○ | ○ |
| 4 | B | 1.753 | 31.4 | 2.9 | 65.7 | 884 | −37 | <0.01 | ○ | ○ |
| 5 | C | 1.395 | 31.4 | 2.7 | 65.9 | 899 | −19 | <0.01 | ○ | ○ |
| 6 | C | 1.514 | 31.4 | 2.7 | 65.9 | 905 | −21 | <0.01 | ○ | ○ |
| 7 | C | 1.692 | 31.4 | 2.7 | 65.9 | 908 | −47 | <0.01 | ○ | ○ |
| 8 | D | 1.38 | 26.8 | 2.7 | 70.5 | 862 | −19 | <0.01 | ○ | ○ |
| 9 | D | 1.374 | 26.8 | 2.7 | 70.5 | 861 | −25 | <0.01 | ○ | ○ |
| 10 | D | 1.654 | 26.8 | 2.7 | 70.5 | 881 | −47 | <0.01 | ○ | ○ |
| 11 | E | 1.499 | 28.5 | 3.1 | 68.4 | 872 | −28 | <0.01 | ○ | ○ |
| 12 | E | 1.655 | 28.5 | 3.1 | 68.4 | 876 | −43 | <0.01 | ○ | ○ |
| 13 | E | 1.772 | 28.5 | 3.1 | 68.4 | 873 | −71 | <0.01 | ○ | ○ |
| 14 | F | 1.722 | 25.2 | 3.6 | 71.2 | 918 | −35 | <0.01 | ○ | ○ |
| 15 | F | 1.691 | 25.2 | 3.6 | 71.2 | 924 | −39 | <0.01 | ○ | ○ |
| 16 | F | 2.094 | 25.2 | 3.6 | 71.2 | 919 | −90 | <0.01 | ○ | ○ |
| 17 | G | 1.492 | 25.5 | 3.9 | 70.6 | 971 | −26 | <0.01 | ○ | ○ |
| 18 | G | 1.546 | 25.5 | 3.9 | 70.6 | 970 | −29 | <0.01 | ○ | ○ |
| 19 | G | 2.024 | 25.5 | 3.9 | 70.6 | 969 | −82 | <0.01 | ○ | ○ |
| 20 | H | 1.656 | 38.7 | 5.2 | 56.1 | 825 | −64 | <0.01 | ○ | ○ |
| 21 | H | 1.768 | 38.7 | 5.2 | 56.1 | 829 | −76 | <0.01 | ○ | ○ |
| 22 | H | 1.836 | 38.7 | 5.2 | 56.1 | 808 | −86 | <0.01 | ○ | ○ |
| 23 | I | 1.78 | 33.2 | 2.9 | 63.9 | 852 | −53 | <0.01 | ○ | ○ |
| 24 | J | 1.729 | 36.9 | 2.7 | 60.4 | 874 | −54 | <0.01 | ○ | ○ |
| 25 | K | 1.763 | 32 | 4.3 | 63.7 | 918 | −65 | <0.01 | ○ | ○ |
| 26 | L | 1.9 | 28.4 | 3.6 | 68 | 885 | −77 | <0.01 | ○ | ○ |
| 27 | M | 2.005 | 31.5 | 6.9 | 61.6 | 884 | −98 | <0.01 | ○ | ○ |
| 28 | N | 2.123 | 27.4 | 4.3 | 68.3 | 891 | −79 | <0.01 | ○ | ○ |
| 29 | O | 2.183 | 27.3 | 8.5 | 64.2 | 864 | −109 | <0.01 | ○ | ○ |
| 30 | P | 1.702 | 25.1 | 5.9 | 69 | 855 | −39 | <0.01 | ○ | ○ |
| 31 | Q | 1.612 | 27.6 | 3.5 | 68.9 | 882 | −40 | <0.01 | ○ | ○ |
| 32 | R | 1.796 | 20.6 | 7.8 | 71.6 | 865 | −42 | <0.01 | ○ | ○ |
| 33 | S | 1.979 | 23.2 | 5 | 71.8 | 915 | −75 | <0.01 | ○ | ○ |
| 34 | T | 1.677 | 31.5 | 5.9 | 62.6 | 866 | −46 | <0.01 | ○ | ○ |
| 35 | U | 1.95 | 19.2 | 3 | 77.8 | 901 | −69 | <0.01 | ○ | ○ |
| 36 | V | 1.811 | 35.6 | 8.7 | 55.7 | 944 | −81 | <0.01 | ○ | ○ |
| 37 | W | 2.057 | 28.4 | 2.8 | 68.8 | 751 | −102 | <0.01 | ○ | ○ |

In each of the steel materials of Nos. 1, 4, 7, 10, 12 to 16 and 19 to 36, β was not smaller than 1.55. These steel products have transition temperatures not higher than −30° C. and good low-temperature toughnesses.

In the steel material of No. 37, β was not less than 1.55, but the yield strength was lower than 758 MPa.

In each of the steel materials of Nos. 2, 3, 5, 6, 8, 9, 11, 17 and 18, β was smaller than 1.5, and the transition temperature was higher than −30° C. These steel products have inferior low-temperature toughnesses.

Although an embodiment of the present invention has been described, the above-described embodiment is merely an example for carrying out the present invention. Therefore, the present invention is not limited to the above-described embodiment, and the above-described embodiment can be modified as necessary without departing from the spirit of the present invention.

INDUSTRIAL APPLICABILITY

The present invention provides a stainless steel having high strength and good SSC resistance at room temperature and good low-temperature toughness which is suitable for use in an oil well.

The invention claimed is:

1. A stainless steel having a chemical composition including, in mass %:

C: 0.001 to 0.06%;
Si: 0.05 to 0.5%;
Mn: 0.01 to 2.0%;
P: up to 0.03%;
S: less than 0.005%;
Cr: 15.5 to 18.0%;
Ni: 2.5 to 6.0%;
V: 0.005 to 0.25%;
Al: up to 0.05%;
N: up to 0.06%;
O: up to 0.01%;
Cu: 0 to 3.5%;
Co: 0 to 1.5%;
Nb: 0 to 0.25%;
Ti: 0 to 0.25%;
Zr: 0 to 0.25%;
Ta: 0 to 0.25%;
B: 0 to 0.005%;
Ca: 0 to 0.01%;
Mg: 0 to 0.01%; and
REM: 0 to 0.05%, further including one or two selected from the group consisting of:

Mo: 0 to 3.5%; and
W: 0 to 3.5% in an amount that satisfies Equation (1), the balance being Fe and impurities, wherein the stainless steel has a matrix structure having, by volume ratio, 40 to 80% tempered martensite, 10 to 50% ferrite and 1 to 15% austenite, when a microstructure image with dimensions of 1 mm×1 mm obtained by photographing the matrix structure at a magnification of 100 times is positioned in an x-y coordinate system with an x-axis extending in a wall-thickness direction and a y-axis extending in a length direction and each of 1024×1024 pixels is represented by a gray scale level, β defined by Equation (2) is not smaller than 1.55:

$$1.0 \leq Mo + 0.5W \leq 3.5 \quad (1),$$

where Mo and W are the Mo and W contents in mass %,

[Formula 1]

$$\beta = \frac{Su}{Sv} \quad (2)$$

in Equation (2), Su is defined by Equation (3), and Sv is defined by Equation (4):

[Formula 2]

$$Su = \sum_{u=1}^{1023} \|F(u, 0)\| \quad (3)$$

$$Sv = \sum_{v=1}^{1023} \|F(0, v)\| \quad (4)$$

in Equations (3) and (4), F(u,v) is defined by Equation (5):

[Formula 3]

$$F(u, v) = \sum_{x=0}^{1023} \sum_{y=0}^{1023} f(x, y) \exp\left\{-2\pi i\left(\frac{ux}{1024} + \frac{vy}{1024}\right)\right\} \quad (5)$$

in Equation (5), f(x,y) represents the gray level of the pixel at coordinates (x,y).

2. The stainless steel according to claim 1, wherein the chemical composition includes one or two selected from the group consisting of, in mass %:

Cu: 0.2 to 3.5%; and
Co: 0.05 to 1.5%.

3. The stainless steel according to claim 1, wherein the chemical composition includes one or more selected from the group consisting of, in mass %:

Nb: 0.01 to 0.25%;
Ti: 0.01 to 0.25%;
Zr: 0.01 to 0.25%; and
Ta: 0.01 to 0.25%.

4. The stainless steel according to claim 1, wherein the chemical composition includes one or more selected from the group consisting of, in mass %:

B: 0.0003 to 0.005%;
Ca: 0.0005 to 0.01%;
Mg: 0.0005 to 0.01%; and
REM: 0.0005 to 0.05%.

5. A stainless steel product for an oil well made of the stainless steel according to claim 1.

6. The stainless steel according to claim 2, wherein the chemical composition includes one or more selected from the group consisting of, in mass %:

Nb: 0.01 to 0.25%;
Ti: 0.01 to 0.25%;
Zr: 0.01 to 0.25%; and
Ta: 0.01 to 0.25%.

7. The stainless steel according to claim 2, wherein the chemical composition includes one or more selected from the group consisting of, in mass %:

B: 0.0003 to 0.005%;
Ca: 0.0005 to 0.01%;
Mg: 0.0005 to 0.01%; and
REM: 0.0005 to 0.05%.

8. . A stainless steel product for an oil well made of the stainless steel according to claim 2.

9. . The stainless steel according to claim 3, wherein the chemical composition includes one or more selected from the group consisting of, in mass %:

B: 0.0003 to 0.005%;
Ca: 0.0005 to 0.01%;
Mg: 0.0005 to 0.01%; and
REM: 0.0005 to 0.05%.

10. . A stainless steel product for an oil well made of the stainless steel according to claim 3.

11. . A stainless steel product for an oil well made of the stainless steel according to claim 4.

12. . The stainless steel according to claim 6, wherein the chemical composition includes one or more selected from the group consisting of, in mass %:

B: 0.0003 to 0.005%;
Ca: 0.0005 to 0.01%;
Mg: 0.0005 to 0.01%; and
REM: 0.0005 to 0.05%.

13. . A stainless steel product for an oil well made of the stainless steel according to claim 6.

14. . A stainless steel product for an oil well made of the stainless steel according to claim 7.

15. A stainless steel product for an oil well made of the stainless steel according to claim 9.

16. A stainless steel product for an oil well made of the stainless steel according to claim 12.

* * * * *